US006305103B1

(12) United States Patent
Camargo

(10) Patent No.: US 6,305,103 B1
(45) Date of Patent: Oct. 23, 2001

(54) FOOTWEAR INCLUDING A LOCKING COMPONENT

(75) Inventor: Ricardo Camargo, Burlington, VT (US)

(73) Assignee: Gravis Footwear, Inc., Burlington, VT (US)

( * ) Notice: Subject to any disclaimer, the term of this patent is extended or adjusted under 35 U.S.C. 154(b) by 0 days.

(21) Appl. No.: 09/515,473

(22) Filed: Feb. 29, 2000

(51) Int. Cl.[7] ..... A43C 11/00
(52) U.S. Cl. ..... 36/50.1; 36/97; 36/45
(58) Field of Search ..... 36/50.1, 50.5, 36/51, 88, 93, 102, 45, 112, 97

(56) References Cited

U.S. PATENT DOCUMENTS

| | | | | |
|---|---|---|---|---|
| D. 361,884 | | 9/1995 | Lozano . | |
| D. 380,891 | | 7/1997 | Brooks et al. . | |
| D. 384,195 | | 9/1997 | Brooks et al. . | |
| D. 385,692 | | 11/1997 | Beliveau . | |
| 160,854 | * | 3/1875 | Tutewiler | 36/51 |
| 1,465,343 | | 8/1923 | Case . | |
| 1,704,688 | * | 3/1929 | Valentine et al. | 36/7.3 |
| 1,759,583 | | 5/1930 | Martin . | |
| 1,818,594 | | 8/1931 | Williams . | |
| 2,097,810 | | 11/1937 | Dawes . | |
| 2,109,751 | | 3/1938 | Matthias et al. . | |
| 2,266,083 | | 2/1941 | Rzepa . | |
| 2,311,996 | | 2/1943 | Parker . | |
| 2,428,262 | | 9/1947 | Bunker . | |
| 2,617,209 | | 11/1952 | Jackson . | |
| 2,969,573 | | 1/1961 | Forrester . | |
| 3,040,454 | | 6/1962 | Topper et al. . | |
| 3,138,880 | | 6/1964 | Kunzil . | |
| 3,568,339 | | 3/1971 | Hara et al. . | |
| 4,245,408 | | 1/1981 | Larsen et al. . | |
| 4,553,342 | | 11/1985 | Derderian et al. . | |
| 4,769,928 | | 9/1988 | Ward . | |
| 5,158,428 | | 10/1992 | Gessner et al. . | |
| 5,381,609 | | 1/1995 | Hieblinger . | |
| 5,555,650 | | 9/1996 | Longbottom et al. . | |
| 5,647,150 | | 7/1997 | Romanato et al. . | |
| 5,765,296 | | 6/1998 | Ludemann et al. . | |
| 5,813,149 | | 9/1998 | Baker et al. . | |

FOREIGN PATENT DOCUMENTS

| | | |
|---|---|---|
| 142 641 | 7/1903 | (DE) . |
| 1 485 720 | 7/1969 | (DE) . |
| 36 29 339 A1 | 3/1988 | (DE) . |
| 87 13 842.5 | 4/1988 | (DE) . |
| 0 710 451 A1 | 5/1996 | (EP) . |
| 0 723 746 A1 | 7/1996 | (EP) . |
| 17219 | 7/1912 | (GB) . |
| 2 134 769 | 8/1984 | (GB) . |
| 2 315 980 | 2/1998 | (GB) . |

* cited by examiner

*Primary Examiner*—Paul T. Sewell
*Assistant Examiner*—Jila Mohandesi
(74) *Attorney, Agent, or Firm*—Wolf, Greenfield & Sacks, P.C.

(57) ABSTRACT

The invention provides a footwear article that may be worn in a first mode which permits easy removal, or may be worn in a second mode that provides a secure fit. The article includes an elastic region and a locking component on at least one of its sides. When worn in the first mode, the elastic region is capable of stretching which may increase the wearer's comfort and facilitates the removing the article and putting on the article on at a later time. When worn in the second mode, a fastener, such as a shoelace, is engaged with the locking component prior to tying. The engagement between the locking component and the shoelace restricts the stretching of the elastic material, thus, maintaining a tight securement of the article on the foot. A variety of footwear articles are contemplated by the invention including shoes and boots.

30 Claims, 4 Drawing Sheets

FOOTWEAR INCLUDING A LOCKING COMPONENT

FIELD OF THE INVENTION

The invention relates generally to footwear and, more particularly, to articles of footwear that include a locking component for securing the article to the foot of a wearer.

BACKGROUND OF THE INVENTION

Footwear, such as shoes or boots, may be secured to the foot of a wearer in a number of ways depending upon the design of the shoe and the activity of the wearer. In some cases, such as during athletic activities, it may be desirable to tightly secure the footwear article to the foot to provide sufficient support. For example, certain shoes designed for such activities are tightly secured by lacing a shoelace through a series of eyelets, pulling the lace tight, and tying the lace. When secured to the foot of the wearer as such, such shoes generally are not readily removed without untying the lace.

In other cases, it may be more comfortable to wear shoes that are more loosely secured to the feet of the wearer. Furthermore, it may be desirable to wear shoes that can easily be put on or removed, for example, without having to tie or untie laces. Some footwear articles include elastic regions, such as gussets, that are capable of stretching and may increase comfort and/or facilitate removing and putting on the article. However such articles generally are not tightly secured to the foot of a wearer in all situations. For example, forces that arise during certain activities, such as those caused by the repeated flexing of the foot, may cause the elastic region to stretch. The stretching of the elastic region reduces the securement of the article on the foot and the support provided by the article. Such articles, therefore, may not be well-suited for certain activities.

Accordingly, in some cases the wearer may want footwear articles to be tightly secured to te his feet while, in other cases, comfort and the ease of removing or putting on the shoe may be more important to the wearer.

SUMMARY OF THE INVENTION

The invention provides a footwear article that may be worn in a first mode which permits easy removal, or may be worn in a second mode that provides a secure fit. The article includes an elastic region and a locking component on at least one of its sides. When worn in the first mode, the elastic region is capable of stretching which may increase the wearer's comfort and facilitates removing the article and putting on the article at a later time. When worn in the second mode, a fastener, such as a shoelace, is engaged with the locking component prior to tying. The engagement between the locking component and the shoelace restricts the stretching of the elastic material, thus, tightly securing the article on the foot. The article enables the wearer to select the mode of wearing most suitable for the particular activity contemplated. Furthermore, the wearer may simply modes without removing the shoe.

In one aspect, the invention provides an article of footwear designed to be worn on a foot of a wearer. The article includes a sole having a top surface. The article further includes an upper section extending upwards from the top surface of the sole and designed to enclose, at least in part, the foot of the wearer. The upper section has a first side including a stretchable elastic region and a locking component. The article further includes a fastener capable of engagement with the locking component to inhibit stretching of the elastic region.

In another aspect, the invention provides an article of footwear designed to be worn on a foot of a wearer. The article includes a sole having a top surface. The article further includes an upper section extending upwards from the top surface of the sole and designed to enclose, at least in part, the foot of the wearer. The upper section has a first and a second side each respectively including a series of receiving members aligned along an upper edge. The first and the second side include a stretchable elastic region positioned between a portion of the series of the receiving members and a locking component. The article further includes a shoelace capable of cooperating with the receiving members to secure the article to the foot and capable of engagement with the locking component to inhibit stretching of the elastic region.

In another aspect, the invention provides an article of footwear designed to be worn on a foot of a wearer in a first mode and a second mode. The article includes a sole having a top surface. The article further includes an upper section extending upwards from the top surface and designed to enclose, at least in part, the foot of the wearer. The upper section has a first side including an elastic region. When the article is worn in the first mode, the elastic region is capable of stretching. When the article is worn in the second mode, stretching of the elastic region is inhibited.

Other advantages, aspects, and features of the invention will become apparent from the following detailed description when considered in conjunction with the accompanying drawings.

DETAILED DESCRIPTION

Figure 1:
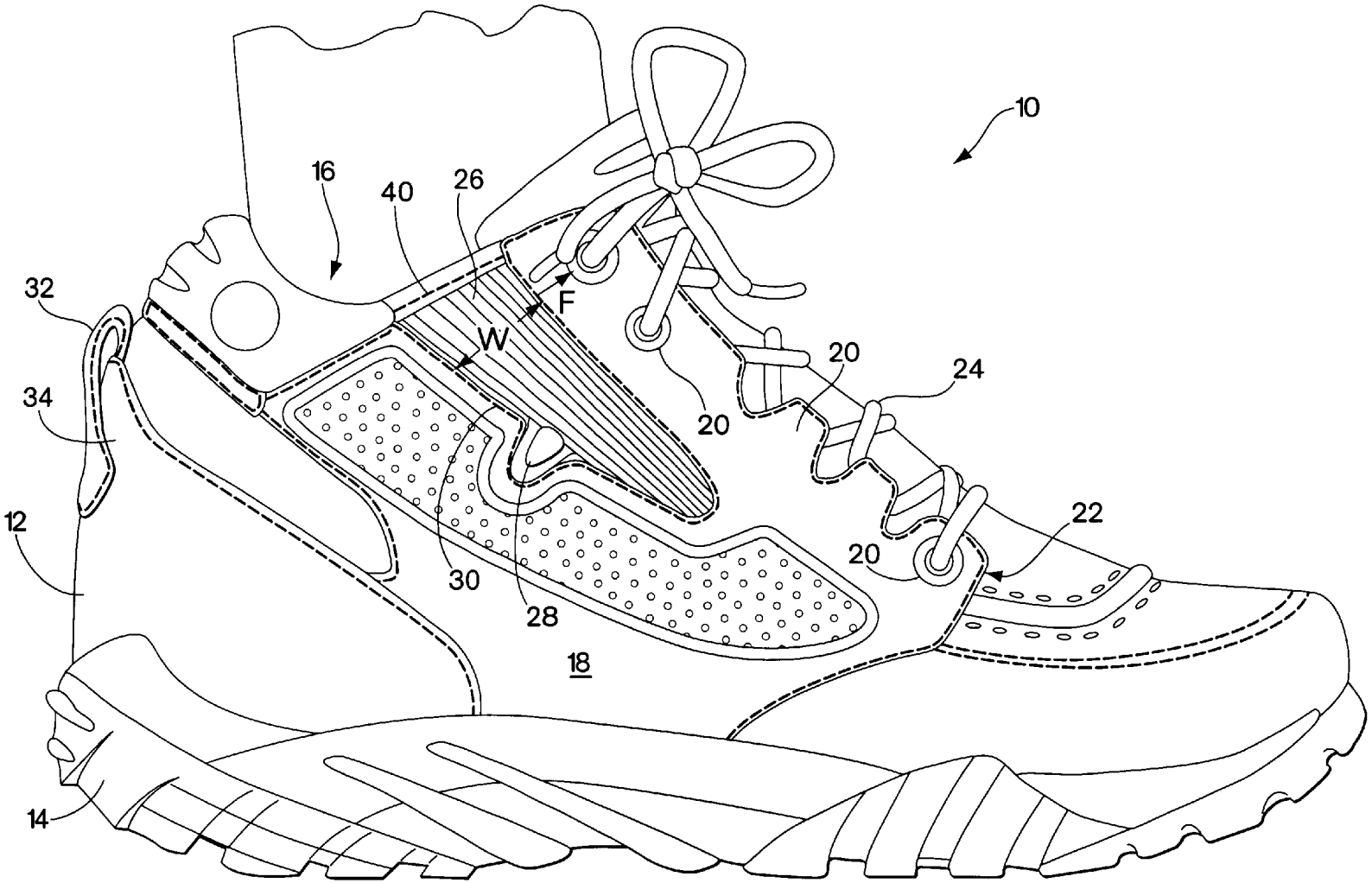
FIG. 1 is a side view of a shoe, in accordance with an embodiment of the invention, worn in a first mode that permits the shoe to be easily removed from the foot of a wearer.

Referring to FIGS. 1–4, a shoe 10 according to one illustrative embodiment of the invention is shown schematically. Shoe 10 includes an upper section 12 which extends upwardly from a sole 14 and defines an opening 16 through which the foot of a wearer may be inserted. The upper section has a first side 18 and a second side 19 which correspond respectively to the right-hand side and the left-hand side of a wearer, when the shoe is worn. Both sides 18, 19 of the upper section in this embodiment include a series of standard receiving members 20 aligned along their respective upper edges 22 which cooperate with a fastener, such as a shoelace 24, when securing the shoe to a foot. In the illustrative embodiment, both sides 18, 19 include an elastic region 26 and a locking component 28 positioned along a lower edge 30 of the elastic region. As described further below, the engagement of the shoelace 24 with the locking component 28 inhibits the stretching of the elastic region 26.

When worn in a first mode as illustrated in FIG. 1, shoe 10 may be secured to the foot of a wearer in conventional fashion by lacing shoelace 24 through the series of receiving members 20 on both sides 18, 19 and tying the lace. In this mode, elastic region 26 is stretchable in response to forces. The stretching causes in an increase in the surface area of the region which can change the shape of the opening 16 and/or an expand the volume enclosed by the outer section. Such stretching may increase the comfort of the wearer and can facilitate removing the shoe from the foot, or, inserting the foot into the shoe when the shoe is being put on. For example, oftentimes, when laced in the first mode, the shoe may be taken off and, subsequently put on without untying the lace.

Forces that stretch the elastic region commonly arise due to movement of the foot during use, such as when the foot flexes. In other cases, the forces may be induced by a wearer, for example, by pulling on a loop 32 attached to a heel portion 34 of the shoe as may be done when removing the shoe. It should be understood that the elastic region may be stretched in any number of directions depending upon the direction and type of the applied force. For example, a force in the direction F may act to increase the width W of the region (FIG. 1).

It may be desirable to wear the shoe in the first mode, for example, when a high degree of support is not required during use and the wearer wants to be able to easily remove the shoe and, during subsequent uses, put the shoe on easily.

Figure 2:
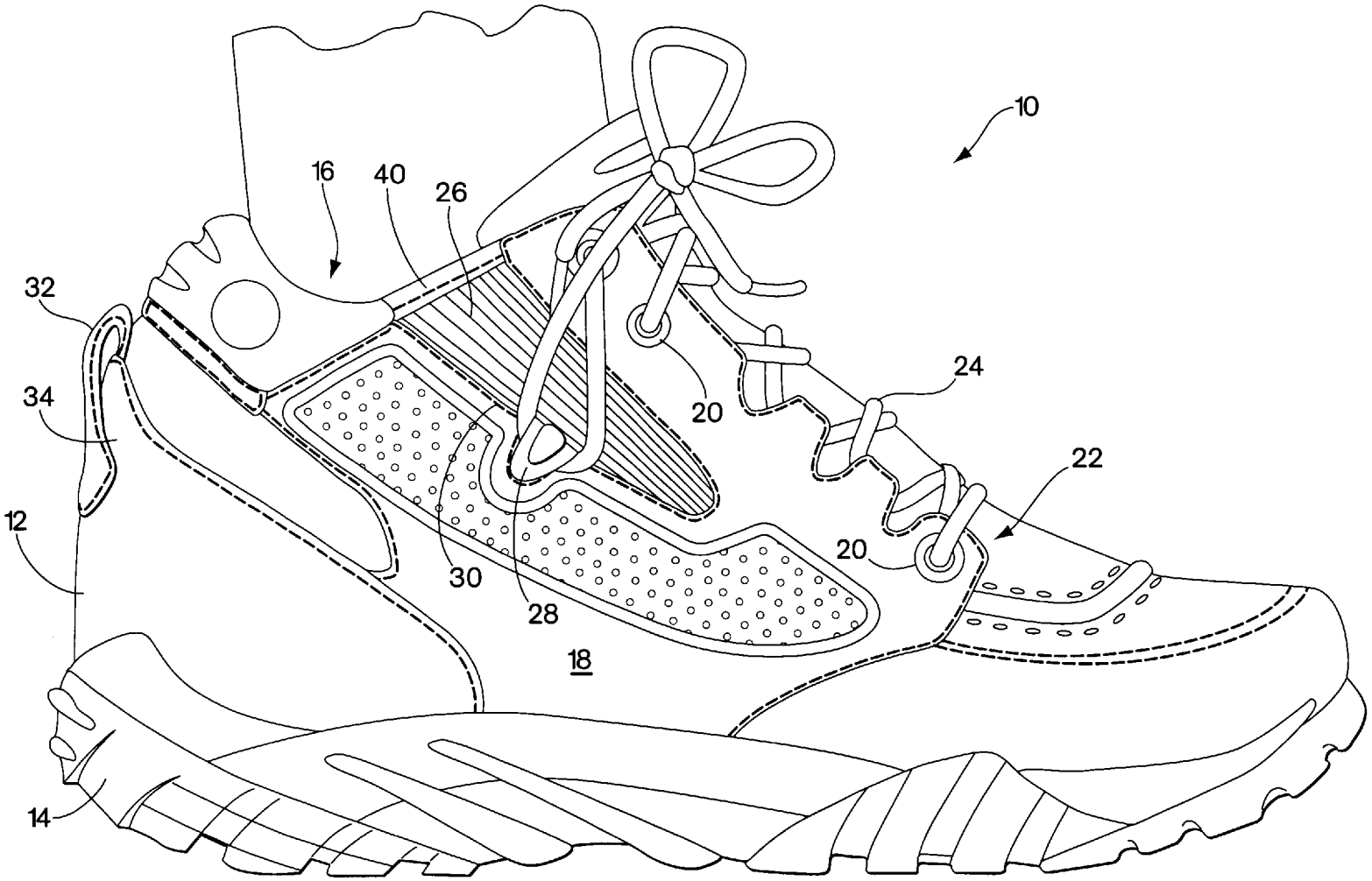
FIG. 2 is a side view of the shoe of FIG. 1 worn in a second mode that tightly secures the shoe to the foot of a wearer.
Figure 3:
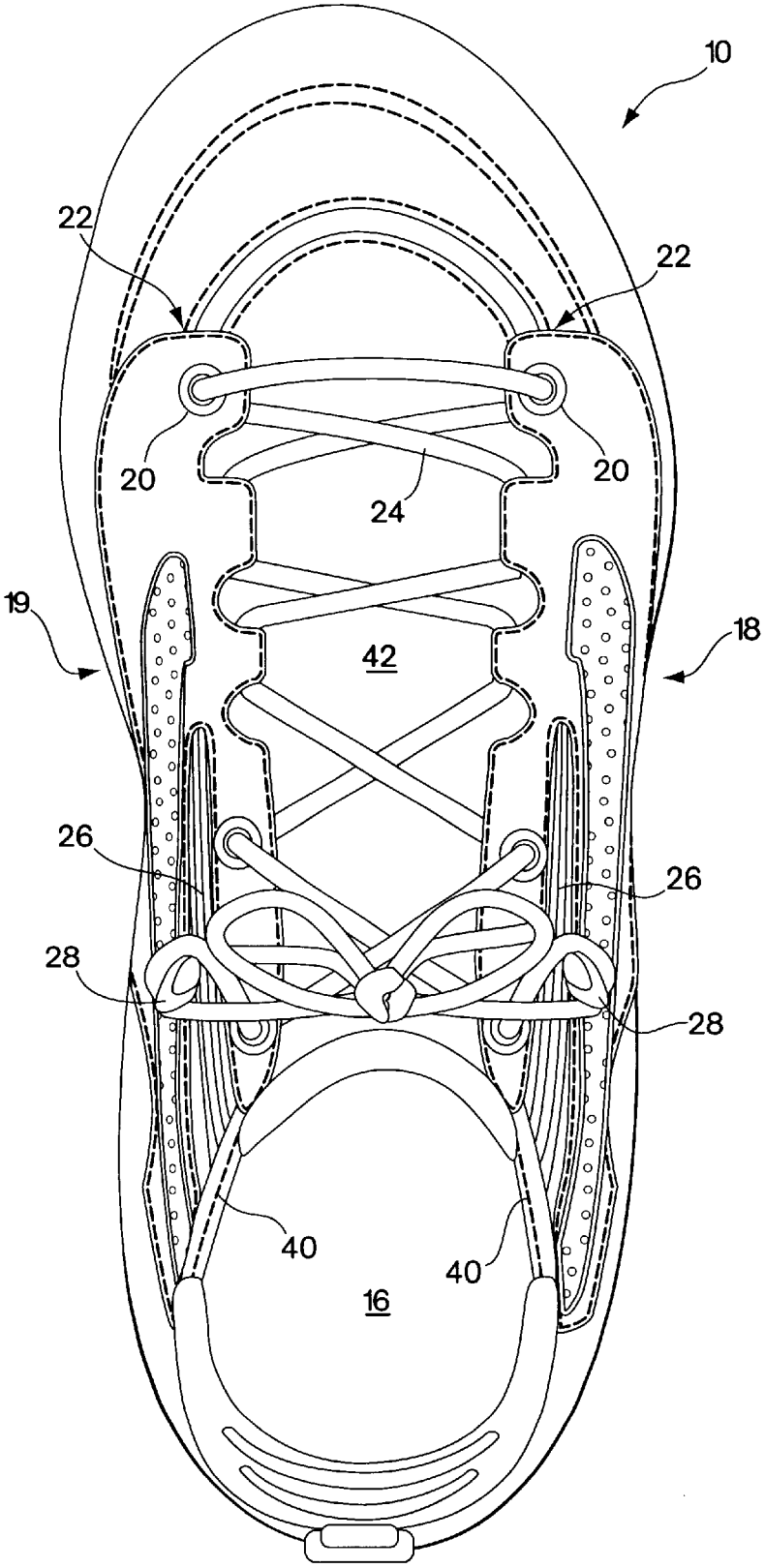
FIG. 3 is an overhead view of the shoe of FIG. 2 worn in the second mode.

Alternatively, shoe 10 may be worn in a second mode, as illustrated in FIG. 2, in which shoelace 24 is engaged with locking component 28. In this illustrative embodiment, the engagement between the shoelace and locking component is accomplished by passing the shoelace underneath a hook portion 36 of the locking component prior to tying the shoelace. In other embodiments, after engagement with the locking component the shoelace may be laced through one or more receiving members prior to tying. It is to be understood that other types of engagement between the fastener and the locking component may be utilized and that the specific type of engagement depends in part upon the construction of the fastener and locking component.

The engagement of the shoelace and the locking component provides a restraining force that counteracts forces that tend to cause elastic region 26 to stretch. As a result of the engagement between the shoelace and locking component, the stretching of the elastic region is inhibited. Thus, the elastic region is not free to stretch as described above in conjunction with FIG. 1. In some embodiments, the engagement may essentially prevent the elastic region from stretching. When worn in the second mode, the tight securement of the shoe to the foot of the wearer is maintained when forces exist that would otherwise cause the elastic region to stretch. It may be desirable to wear the shoe in the second mode when adequate support is required, for example, during physical activities when the foot is frequently flexed such as in hiking, climbing, running, or snowboarding.

Upper section 12 may have any suitable construction known in the art to enclose, at least in part, the foot of a wearer. As illustrated, upper section extends to about the level of the ankle, though in other embodiments the upper section may extend above the ankle (e.g., boots) or below the ankle. In the illustrative embodiment, the upper section includes a tongue 42 which bridges the space between the respective upper edges 22 of first side 18 and second side 19 to protect the top side of the foot. The tongue defines in part opening 16 and may be padded to increase the comfort of the wearer. In some embodiments, the upper section includes multiple functional components in addition to the components described above. For example, heel portion 34 of the upper section may include a padded inner member 38 to increase comfort and/or a reinforced outer member (not illustrated) to provide support. Different components of the upper section may be joined together by any suitable technique including by stitching or with an adhesive.

It should be understood that though the upper section of the illustrative embodiment includes the combination of elastic region 26 and locking component 28 on both the first and second sides of the shoe, other embodiments may include the elastic region and the locking component on only one side of the upper section.

Elastic region 26 may be positioned anywhere on the upper section such that the region is capable of stretching when the locking component is not engaged. In the illustrative embodiment, the elastic region is positioned between the locking component and several of the receiving members along upper edge 22. As such, elastic region 26 has an upper portion 40 that defines part of opening 16 and extends downwardly in a direction generally parallel to the series of receiving members. In this embodiment, the elastic region is generally V-shaped with its width W decreasing in the direction away from the opening. Such a shape may be advantageous, in certain embodiments, by enhancing the extensibility of elastic region 26 at opening 16 to facilitate putting the shoe on or removing the shoe. Elastic region 26 extends through the entire thickness of upper section 18 and may be attached to adjacent regions of the upper section, for example, by stitching. In some embodiments, the elastic region may have an surface area between about 0.5 square inches and 10 square inches, in other embodiments between about 1.0 square inches and 4.0 square inches. However, it is to be understood that the dimensions, shape, and placement of the elastic region may be varied as desired for the particular type of footwear. For example, articles of footwear that extend over the ankle may include an elastic region that is vertically oriented. The elastic region may be made of any of elastic material known in the art including, but not limited to, Gore-elastic, fabric elastic, Neoprene, and Lycra. In some embodiments, elastic region 26 may be covered, for example, by another material for aesthetics. In these embodiments, generally, the covering does not restrict the ability of the elastic region 26 to stretch.

As described above, locking component 28 is positioned along lower edge 30 of the elastic region. In other embodiments, the locking component may be positioned at any point on the shoe such that when the locking component engages shoelace 24 the elastic region is sufficiently constrained from stretching in response to forces. Locking component 28, in some embodiments and as illustrated, may be a separate component attached to the upper section, for example, by sewing. When the locking component is a separately attached component, it may be made of a relatively rigid material such as a plastic or a metal. In other embodiments, the locking component may be an integral portion of the upper section, for example, as a loop or an eyelet.

Figure 4:
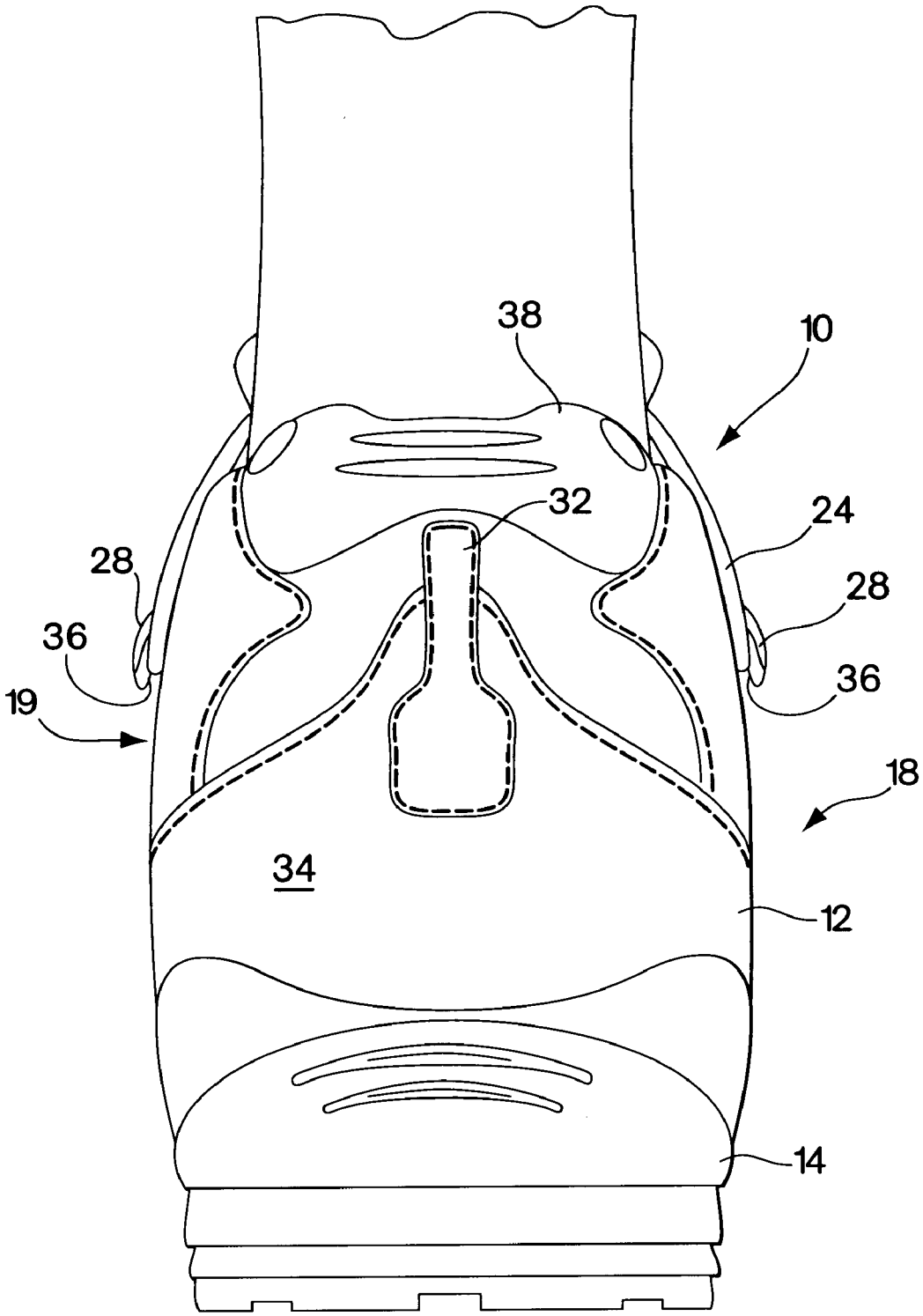
FIG. 4 is a back view of the shoe of FIG. 2 worn in the second mode.

As illustrated best in FIG. 4, locking component 26 projects outwardly from the upper section and curves downward away from the elastic region to form a hook-shape. As such, shoelace 22 may be quickly and easily laced around the locking component and sufficiently engaged by the hook. In other embodiments, the locking component may have a variety of constructions which are capable of engaging the lace. In some embodiments, shoe 10 may include multiple locking components on the same side which may be engaged by the fastener to provide further securement.

In the illustrative embodiment, the series of receiving members 20 are aligned along the respective upper edges 22 of sides 18, 19. Receiving members 20 may be any of the type known in the art for use on footwear capable of cooperating with fasteners such as shoelace 24. For example, the receiving members may be eyelets, hooks, or loops. The shoe may include different types of receiving members, as shown, or all of the same type.

The following example illustrates on manner in which the shoe 10 may be used. Prior to being worn, the shoe is laced in a manner in which shoelace 24 is passed through receiving members 20 and tied as shown in FIG. 1. To put the shoe on, the wearer inserts part of the foot into opening 16 and pulls on loop 32 in a direction away from the shoe to stretch elastic region 26. The stretching of the elastic region widens opening 16 and permits the foot to be completely inserted into the shoe, even when the shoe is tied. The shoe may be worn in this first mode to provide the advantages described above. When more support is desired, for instance if the wearer is about to begin an athletic activity, the shoe may easily be converted to the above-described second mode. To convert to the second mode, the wearer simply unties the lace, passes each end of the lace under the locking component so that the locking component engages the lace, pulls the lace tight, and re-ties the lace. When the athletic activity is finished, the wearer may untie the lace to remove the shoe or to convert back to the first mode by disengaging the lace from the locking component and re-tying the lace. If the wearer converts back to the first mode of wearing, the shoe may be later removed without untying the lace by stretching the elastic region, for example by once again pulling on loop 32 in a direction away from the shoe.

Though the embodiment illustrated in FIGS. 1–4 is an athletic shoe, the combination of the elastic region and the locking component may be utilized in conjunction with any type of footwear including boots, dress shoes, and the like. In addition, various modifications of the illustrative embodiment are envisioned. For example, the combination of the elastic region and locking component may be used on footwear that employs a strap as a fastener, instead of a shoelace. Such modifications and improvements are intended to be within the spirit and the scope of the invention. Accordingly, the foregoing description is by way of example only and is not intended as limiting. The invention is limited only as defined by the following claims and their equivalents.

What is claimed is:

1. An article of footwear having a shoelace and designed to be worn on a foot of a wearer comprising:

a sole having a top surface; and an upper section extending upwards from the top surface of the sole and designed to enclose, at least in part, the foot of the wearer, the upper section having a first side including a stretchable elastic region and a locking component, wherein the locking component is engagable by the shoelace to inhibit stretching of the elastic region.

2. The article of claim 1, wherein the elastic region is stretchable when the the locking component is not engaged by the shoelace.

3. The article of claim 2, wherein stretching the elastic region increases a volume enclosed by the upper section.

4. The article of claim 1, wherein the engagement between the locking component and the shoelace essentially prevents the stretching of elastic region.

5. The article of claim 1, further comprising at least one receiving member constructed and arranged to cooperate with the shoelace to secure the article to the foot of the wearer.

6. The article of claim 5, wherein the elastic region is stretchable when the shoelace cooperates with the at least one receiving member to secure the article to the foot of the wearer and the locking component is not engaged by the shoelace.

7. The article of claim 5, wherein the elastic region is positioned between the at least one receiving member and the locking component.

8. The article of claim 5, wherein the upper section includes a plurality of receiving members aligned respectively along an upper edge of the first side and along an upper edge of a second side of the article.

9. The article of claim 5, wherein at least a portion of the receiving members comprise eyelets.

10. The article of claim 1, wherein the locking component is hook-shaped.

11. The article of claim 1, wherein the locking component is positioned proximate an edge of the elastic region.

12. The article of claim 1, wherein the first side of the upper section includes a plurality of locking components.

13. The article of claim 1, wherein the upper section has a second side including a second elastic region and a second locking component, the second locking component being engagable by the shoelace to inhibit stretching of the second elastic region.

14. The article of claim 1, wherein the elastic region comprises a gusset.

15. The article of claim 8, wherein the elastic region is oriented in a direction substantially parallel to the direction defined by the alignment of the receiving members along the upper edge of the first side.

16. The article of claim 1, wherein the elastic region is oriented in a vertical direction.

17. The article of claim 1, wherein the elastic region comprises a material selected from the group consisting of Gore-elastic, Neoprene, Lycra, and fabric elastic.

18. The article of claim 1, further comprising a material covering the elastic region.

19. The article of claim 1, wherein the article comprises an athletic shoe.

20. The article of claim 1, wherein the article comprises a boot.

21. An article of footwear designed to be worn on a foot of a wearer comprising:

a sole having a top surface;

an upper section extending upwards from the top surface of the sole and designed to enclose, at least in part, the foot of the wearer, the upper section having a first and a second side each respectively including a series of receiving members aligned along an upper edge, the first and the second side including a stretchable elastic region positioned between a portion of the series of the receiving members and a locking component; and a shoelace capable of cooperating with the receiving members to secure the article to the foot and capable of engagement with the locking component to inhibit stretching of the elastic region.

22. An article of footwear designed to be laced on a foot of a wearer in a first mode and a second mode, the article comprising:

a sole having a top surface; and an upper section extending upwards from the top surface and designed to enclose, at least in part, the foot of the wearer, the upper section having a first side including an elastic region, wherein when the article is laced in the first mode the elastic region is capable of stretching, and when the article is laced in the second mode stretching of the elastic region is inhibited.

23. The article of claim 22, further comprising a shoelace and the upper section further includes a locking component, wherein when the article is laced in the second mode the shoelace engages the locking component to inhibit stretching of the elastic region.

24. The article of claim 23, wherein when the article is laced in the first mode the shoelace does not engage the locking component.

25. The article of claim 23, wherein the upper section further includes at least one receiving member constructed and arranged to cooperate with the shoelace to secure the article to the foot of the wearer.

26. The article of claim 22, wherein when the article is laced in the second mode stretching of the elastic region is essentially prevented.

27. The article of claim 22, wherein the article may be converted from being laced in the first mode to being laced in the second mode without removing the article.

28. An article of footwear designed to be worn on a foot of a wearer comprising:

a sole having a top surface;

an upper section extending from the top surface of the sole and designed to enclose, at least in part, the foot of the wearer, the upper section being defined by a contiguous portion including a stretchable elastic region and a locking component; and a securing element engagable by the locking component to inhibit stretching of the elastic region.

29. The article of claim 28, wherein the locking component is positioned along a lower edge of the stretchable elastic region.

30. The article of claim 28, wherein the securing element comprises a shoelace.

* * * * *